United States Patent [19]

Olsson

[11] 4,324,018

[45] Apr. 13, 1982

[54] PAINT EQUIPMENT CLEANING TOOL

[76] Inventor: Sven O. Olsson, 7951 Chicago Ave. South, Minneapolis, Minn. 55420

[21] Appl. No.: 141,065

[22] Filed: Apr. 17, 1980

[51] Int. Cl.[3] ..... B44D 3/00

[52] U.S. Cl. ..... 15/236 R; 15/104.04; 15/105; 15/245

[58] Field of Search ..... 15/257 R, 236 R, 105, 15/111, 104.04, 245, 401

[56] References Cited

U.S. PATENT DOCUMENTS

| | | | |
|---|---|---|---|
| D. 27,141 | 6/1897 | Crossman | D7/181 |
| D. 247,278 | 2/1978 | Dunn, Jr. | D7/181 |
| 790,228 | 5/1905 | Rohrer | 15/236 R X |
| 2,860,858 | 11/1958 | Kurs | 15/236 R X |
| 3,019,467 | 2/1962 | Garrett | 15/236 R |
| 3,373,456 | 3/1968 | Dalton | 15/236 R X |
| 3,707,740 | 1/1973 | Demers | 15/236 R |

*Primary Examiner*—Chris K. Moore

*Attorney, Agent, or Firm*—Burd, Bartz & Gutenkauf

[57] ABSTRACT

A paint applicator cleaning tool for cleaning painting equipment, such as a paint roller, paint pads, and paint pans. The tool comprises a flat base having a first side with a first arcuate notch having an uninterrupted edge and curved to substantially conform to the outer periphery of a portion of a standard paint roller. A second side of the base has a second arcuate notch having a plurality of teeth operable to fluff the nap of the paint roller. The base has a third side which includes an elongate linear edge for cleaning paint pads and pans and the like.

17 Claims, 13 Drawing Figures

PAINT EQUIPMENT CLEANING TOOL

SUMMARY OF INVENTION

The invention pertains to a tool for use in cleaning paint from certain paint applicators and equipment, such as rollers, pads, and pans. Cleaning of such equipment by present means is tedious and wasteful of paint. Rollers and pads carry a paint absorbent nap or pile. Cleaning such nap is often accomplished by wiping with rags or newspaper. This is inefficient, wasteful of paint, and often messy.

The present invention comprises a tool for use in cleaning paint rollers, spreaders, trays, pans, and other such painting equipment. The invention includes a flat base member having a plurality of working sides for performance of cleanup functions. One side has an arcuate notch with a continuous, smooth uninterrupted edge. The curvature of the notch corresponds to the outer circumference of a standard paint roller. The notch comprises an arc of a circle having a diameter corresponding to the outer diameter of a standard size paint roller. A second side has an arcuate notch having an edge formed with a plurality of teeth. The curvature of the notch corresponds to the outer circumference of a standard size paint roller. The teeth are adapted to be moved through the nap formed on the outer perimeter of a standard paint roller. A third side has a smooth linear edge for movement over flat surfaces, such as a paint pad or pan, to remove paint therefrom.

IN THE DRAWINGS

DESCRIPTION OF PREFERRED EMBODIMENT

Figure 1:
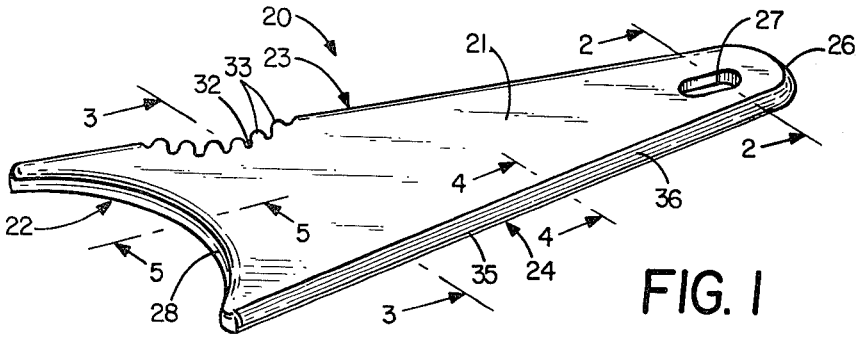
FIG. 1 is a perspective view of a paint equipment cleaning tool according to the present invention.
Figure 2:
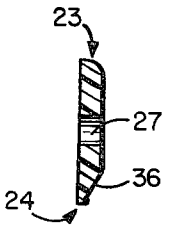
FIG. 2 is an enlarged sectional view of a portion of the cleaning tool of FIG. 1 taken along the line 2—2 thereof.
Figure 3:
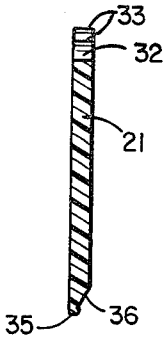
FIG. 3 is an enlarged sectional view of a portion of the cleaning tool of FIG. 1 taken along the line 3—3 thereof.

Referring to the drawings, there is shown in FIG. 1 a paint cleaning tool according to the invention indicated generally at 20 and comprising a base member 21 generally having the shape of an isosceles triangle. Base 21 has a first side or end 22 and second and third substantially equal length sides 23, 24 converging from the end 22 toward a rounded apex 26. A mounting opening 27 is provided in the base member 21 near the apex 26 (see FIG. 2) for hanging the base member 21 on a wall, a painter's belt, or the like.

Figure 5:
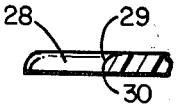
FIG. 5 is an enlarged sectional view of a portion of the cleaning tool of FIG. 1 taken along the line 5—5 thereof.

End 22 of base member 21 is provided with a first arcuate concave notch 28 formed therein. Notch 28 is a generally circular arc having a curvature corresponding to the circumferential curvature of the perimeter of a standard paint roller. Notch 28 has a continuous uninterrupted side with an upper rounded edge 29 and a lower sharp edge 30, as viewed in FIG. 5. Notch 29 is adapted for engagement with the perimeter of a paint roller for removal of paint therefrom using either the rounded edge 29 or the sharp edge 30 according to the nature of the nap of the paint roller.

Second side 23 of base member 21 has a second arcuate notch 32 formed therein and comprised as a generally circular arc described about a diameter substantially corresponding to the diameter of a standard paint roller. Second notch 32 has a plurality of teeth 33 formed in the side wall thereof and protruding radially inward of notch 32. Notch 32 is adapted for engagement of a portion of the perimeter of a paint roller with teeth 33 in engagement with the nap thereof to separate and raise the nap in order to enhance the paint applicating characteristics of the paint roller.

Third side 24 of base member 21 is provided with an elongate linear edge 35. Linear edge 35 can be relatively sharp compared to the normal width of member 21 and is formed by a tapered surface 36 between the planar surfaces of base member 21. Linear edge 35 is adapted for engagement of flat or planar surfaces for removal of paint therefrom.

Figure 4:
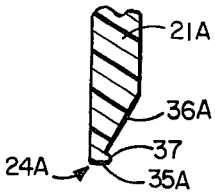
FIG. 4 is an enlarged sectional view like that of FIG. 3 showing a modification of the cleaning tool.

A modification of the third side 24 is shown in FIG. 4 where there is provided a flat plate member 21A having a third side 35A. Third side 35A is relatively sharp, as compared to the normal width of plate member 21A, being formed thereon by a tapered surface 36A. A bead 37 extends the length of third side 24A and extends forward in the direction of taper 36A. Bead 37 is instrumental in the removal of paint from soft or nap surfaces.

Figure 6:
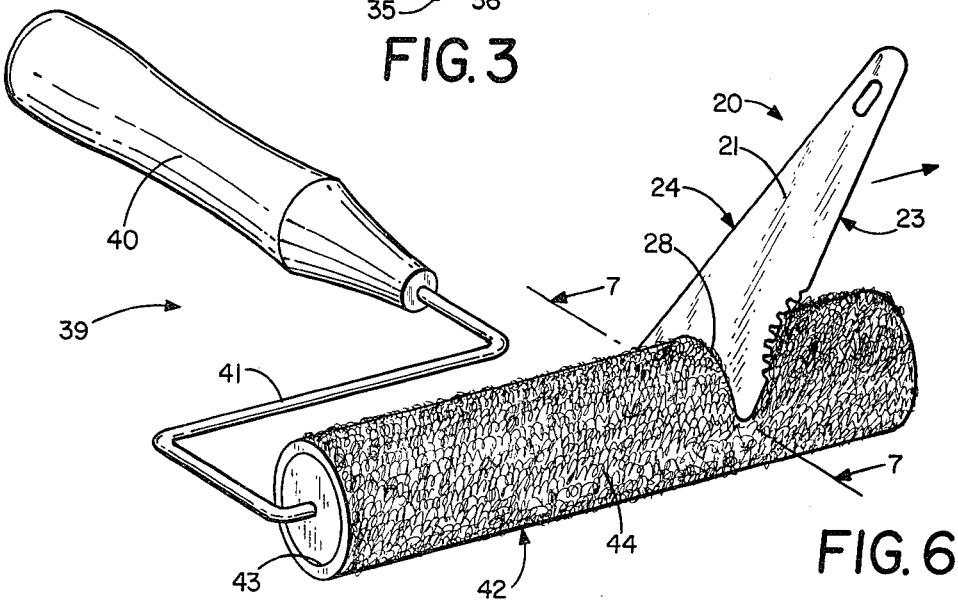
FIG. 6 is a perspective view of a paint roller and a cleaning tool of the present invention in operative relationship to the paint roller in a first mode of operation.
Figure 7:
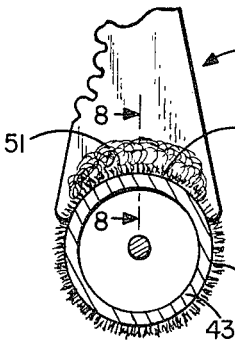
FIG. 7 is a sectional view of the paint roller and cleaning tool of FIG. 6 taken along the line 7—7 thereof.
Figure 8:
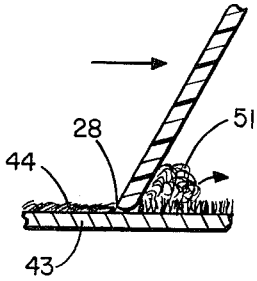
FIG. 8 is an enlarged sectional view of a portion of the paint roller and cleaning tool shown in FIG. 7 taken along the line 8—8 thereof.

Use of the cleaning tool 20 in a first mode of operation is illustrated in FIGS. 6 through 8. A roller assembly 39 has the usual handle 40 and a frame 41. A cylindrical paint roller 42 is rotatably mounted on the frame 21 and has a cylindrical core 43 covered by a paint absorbent nap surface 44. Nap surface 44 can have a long thick nap or a short nap, depending on the type of surface being painted. Upon completion of painting, cleaning tool 20 is used to strip excess paint from the roller 42. As paint is stripped from the nap 44, it can be drained into a receptacle, such as back into the paint can. Notch 28 of end 22 is placed in engagement with a portion of the perimeter of roller 42 at one end thereof; for example, at the left end thereof, as viewed in FIG. 6. The tool 20 is then manually drawn along the length of the roller 42 parallel to the axis thereof. As the notch 40 moves along the surface of the roller, paint 46 is moved ahead of it and then off the opposite end of the roller. The roller is then rotated and the tool 20 repositioned at another circumferential location on the roller wherein the process is repeated until the entire circumference of the roller has been covered. Residual paint on the roller is cleaned off by the usual method, such as washing with paint cleaner or water.

Figure 9:
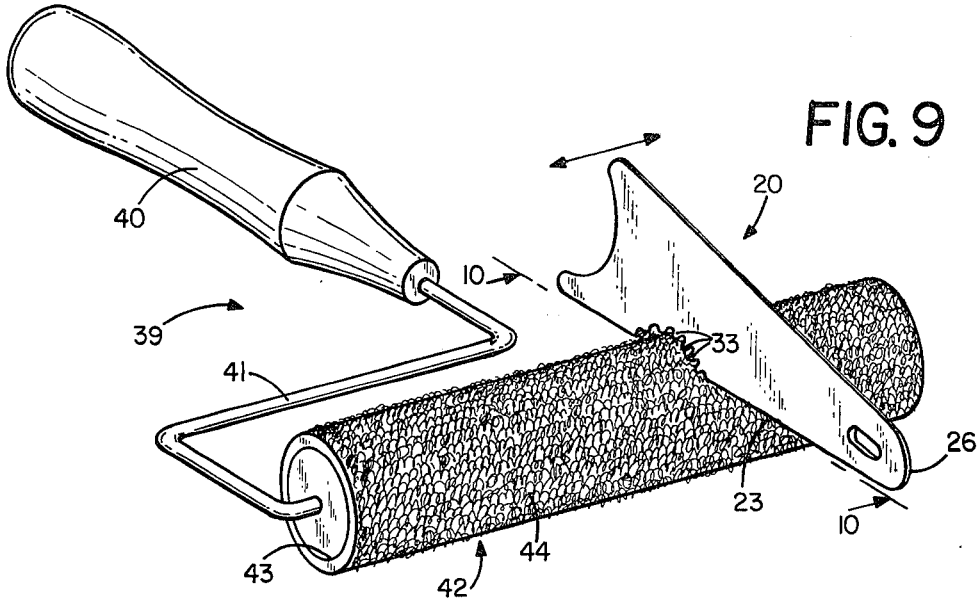
FIG. 9 is a perspective view of a cleaning tool in operative relationship to a paint roller in a second mode of operation.
Figure 10:
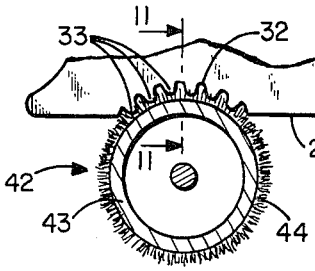
FIG. 10 is a sectional view of the paint roller and cleaning tool of FIG. 9 taken along the line 10—10 thereof.
Figure 11:
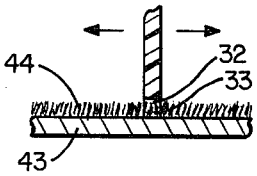
FIG. 11 is an enlarged sectional view of the paint roller and cleaning tool of FIG. 10 taken along the line 11—11 thereof.

Use of cleaning tool 20 in a second mode of operation is illustrated in FIGS. 9 through 11 wherein the nap 44 of roller 42 has been previously cleaned and is now matted or bunched together. The tool 20 is useable to restore the nap to its original texture and appearance. Second notch 32 is placed in contact with a peripheral portion of roller 42 with the teeth 33 engaged in the nap 44. The tool is manually moved back and forth axially with respect to roller 42 with the teeth 33 moving through the nap 44. This action combs and restores the nap to its original condition preparatory to reuse of roller assembly 39 for painting. The action is repeated until the entire periphery of the roller 42 has been covered. As the teeth 33 move through the nap 44, the nap is elevated and separated to better restore it for receipt of paint.

Figure 12:
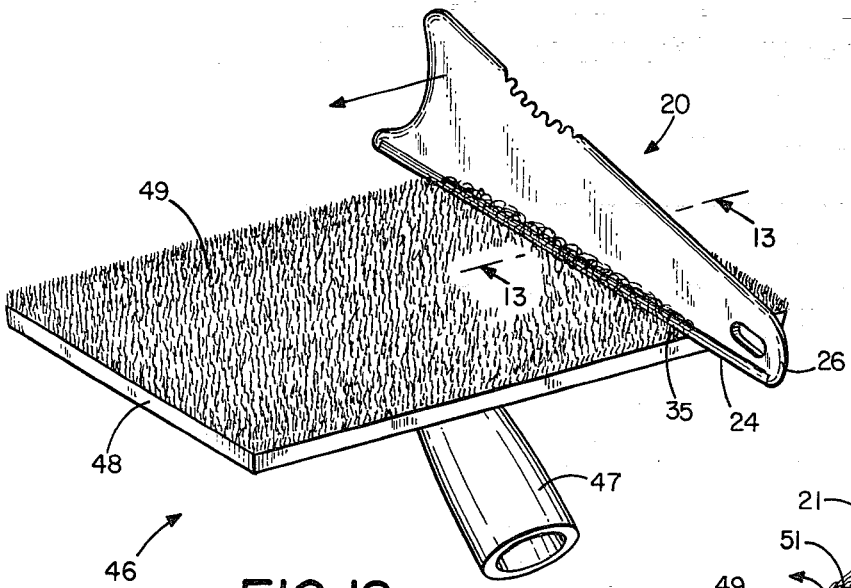
FIG. 12 is a perspective view of a cleaning tool of the invention shown in operative relationship to a paint pad in a third mode of operation.
Figure 13:
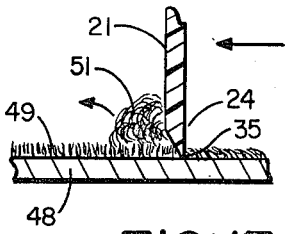
FIG. 13 is an enlarged sectional view of the paint pad and cleaning tool of FIG. 12 taken along the line 13—13 thereof.

A third mode of operation of cleaning tool 20 is illustrated in FIGS. 12 and 13, where there is shown a paint applicator or pad assembly 46 having a handle 47 and a flat base 48. Base 48 is covered by a surface having a nap 49 for absorption and application of paint. In the cleaning of excess paint from applicator 46, tool 20 is applied to the nap 49 with the linear edge 35 of third side 24 in contact with nap 49. The tool 20 is manually drawn from one edge of the base 48 toward the opposite edge. As it is so drawn along base 48, paint 51 is pushed ahead of the linear edge 35 and finally off the edge of base 48 where it can be recovered in a suitable container. The sequence can be repeated to strip the maximum of paint from the nap 49 on base 48 following which residual paint can be cleaned off by usual means, such as paint cleaner or water.

While there has been shown and described one example of a preferred embodiment of a paint tool according to the invention, it will be apparent that deviation and variation from the embodiment shown can be had without departing from the scope and spirit of the invention. The invention is defined in the following claims.

The embodiments of the invention in which an exclusive property or privilege is claimed are defined as follows:

1. A paint applicator cleaning tool comprising: a flat base having a first side with a first arcuate notch having uninterrupted edges and curved to substantially conform to the outer perimeter of a portion of a standard paint roller; said base having a second side with a second arcuate notch having edges with a plurality of teeth and curved to substantially conform to the outer perimeter of a portion of a standard paint roller; said base having a third side having a tapered surface forming an elongate linear edge; an elongate linear bead located on said linear edge.

2. The paint applicator cleaning tool of claim 1 wherein: said base is generally triangular in shape, said first, second, and third sides being sides of said triangular shape.

3. The paint applicator cleaning tool of claim 1 wherein: said base generally has the shape of an isosceles triangle with said second and third sides being substantially of equal length.

4. A paint applicator cleaning tool comprising: a flat base having a first side with a first arcuate notch having uninterrupted edges and curved to substantially conform to the outer perimeter of a portion of a standard paint roller, said first arcuate notch having a curved edge on one surface of said base and a square edge on the opposite surface of said base; said base having a second side with a second arcuate notch having edges with a plurality of teeth and curved to substantially conform to the outer perimeter of a portion of a standard paint roller; said base having a third side having an elongate linear edge.

5. The paint applicator cleaning tool of claim 4 including: a mounting opening located in said base for mounting said tool when not in use.

6. A paint applicator cleaning tool comprising: a base having a first side with an arcuate notch having edge means curved to substantially conform to the outer curved shapes of a portion of a conventional paint roller, said base having a second side having an elongated linear edge, an elongated linear bead located on said linear edge.

7. The tool of claim 6 wherein: said edge means has a plurality of teeth.

8. The tool of claim 6 wherein: said edge means has an uninterrupted concave edge.

9. The tool of claim 6 wherein: the base is generally triangular in shape.

10. A paint applicator cleaning tool comprising: a base having a first side with an arcuate notch having edge means curved to substantially conform to the outer curved shape of a portion of a conventional paint roller, said edge means having an uninterrupted concave curved edge joined to a square edge, said base having a second side having an elongated linear edge.

11. The tool of claim 10 including: an elongated linear bead located on said linear edge.

12. A paint applicator cleaning tool comprising: a base having a first side and a second side, each side having an arcuate notch having edge means curved to substantially conform to the outer curved shape of a portion of a conventional paint roller, one of the edge means having an uninterrupted concave edge, said edge having a transverse convex portion and a square portion.

13. The tool of claim 12 wherein: one of the edge means has a plurality of teeth.

14. The tool of claim 12 wherein: one of the edge means has an uninterrupted concave edge.

15. The tool of claim 12 wherein: one of the edge means has a plurality of teeth and the other of the edge means has an uninterrupted concave edge.

16. The paint applicator cleaning tool of claim 4 wherein: said third side has a tapered surface forming said edge.

17. The paint applicator cleaning tool of claim 4 including: an elongate linear bead located on said linear edge.

* * * * *